US008820339B2

(12) United States Patent
Goodwin

(10) Patent No.: US 8,820,339 B2
(45) Date of Patent: Sep. 2, 2014

(54) WALKING AIDS

(75) Inventor: David Malcolm Goodwin, Pyrford (GB)

(73) Assignee: Flexyfoot Limited, Surrey (GB)

( * ) Notice: Subject to any disclaimer, the term of this patent is extended or adjusted under 35 U.S.C. 154(b) by 374 days.

(21) Appl. No.: 12/733,448

(22) PCT Filed: Sep. 4, 2008

(86) PCT No.: PCT/GB2008/002990

§ 371 (c)(1),
(2), (4) Date: Mar. 2, 2010

(87) PCT Pub. No.: WO2009/030906

PCT Pub. Date: Mar. 12, 2009

(65) Prior Publication Data

US 2010/0307549 A1 Dec. 9, 2010

(30) Foreign Application Priority Data

Sep. 4, 2007 (GB) ..... 0717167.1

(51) Int. Cl.
*A45B 9/04* (2006.01)
*A61H 3/02* (2006.01)
*A63C 11/22* (2006.01)

(52) U.S. Cl.
CPC ..... *A61H 3/0277* (2013.01); *A63C 11/221* (2013.01); *A61H 3/0288* (2013.01); *A45B 9/04* (2013.01)
USPC ..... 135/84; 135/82; 135/86

(58) Field of Classification Search
CPC ..... A45B 9/04; A61H 3/0288; A61H 3/0277; A61H 2003/0283
USPC ..... 135/65, 77, 82, 84, 86; 16/42 T, 42 R
See application file for complete search history.

(56) References Cited

U.S. PATENT DOCUMENTS

| | | | | |
|---|---|---|---|---|
| 1,429,429 | A * | 9/1922 | Hipwood | 135/84 |
| 2,397,499 | A | 4/1946 | McGowan | |
| 2,856,943 | A | 10/1958 | Sparlin | |
| 2,888,022 | A | 5/1959 | Fanning | |
| 4,141,375 | A * | 2/1979 | Tykwinski | 135/66 |

(Continued)

FOREIGN PATENT DOCUMENTS

| | | | |
|---|---|---|---|
| BE | 1011515 | A6 | 10/1999 |
| DE | 87 15 707 | U1 | 3/1988 |

(Continued)

OTHER PUBLICATIONS

English Computer Translation Description and Claims of BE 1011515, published Oct. 5, 1999, Laureyssens (6 pages).

*Primary Examiner* — David R Dunn
*Assistant Examiner* — Danielle Jackson
(74) *Attorney, Agent, or Firm* — Dicke, Billig & Czaja, PLLC

(57) ABSTRACT

Walking aids are described which are of simple construction but which allow for both resilience, i.e. the part of the walking aid which is gripped by the user and the ground-engaging end (3) can be resiliency pressed together, as well as a degree of angular flexibility so that the end (3) stays aligned with the ground even if the stick, crutch or the like (1) is angled relative thereto. This is achieved in particular by the use of a bellows structure (2) between the shaft (1) of a walking aid and a ground-engaging foot (3).

7 Claims, 4 Drawing Sheets

(56) References Cited

U.S. PATENT DOCUMENTS

| | | | | |
|---|---|---|---|---|
| 4,510,957 | A | 4/1985 | Frank | |
| 4,881,564 | A | 11/1989 | Fetterman | |
| 5,865,204 | A | 2/1999 | Bracy | |
| 6,055,998 | A | 5/2000 | Bader | |
| 6,910,246 | B2 * | 6/2005 | Desmarais | 16/42 R |
| 2004/0035453 | A1 | 2/2004 | McGrath | |
| 2007/0089770 | A1 | 4/2007 | Park | |

FOREIGN PATENT DOCUMENTS

| | | | |
|---|---|---|---|
| DE | 41 36 210 | C1 | 12/1992 |
| DE | 41 31 330 | A1 | 3/1993 |
| DE | 19503565 | A1 * | 8/1996 |
| EP | 0 112 141 | A2 | 6/1984 |
| EP | 0 605 935 | A1 | 7/1994 |
| EP | 1 707 175 | A1 | 10/2006 |
| FR | 1593308 | A * | 5/1970 |
| FR | 2 715 559 | A1 | 8/1995 |
| FR | 2 820 618 | A1 | 8/2002 |
| GB | 124691 | | 4/1919 |
| GB | 613046 | | 11/1948 |
| GB | 2 339 682 | A | 2/2000 |
| GB | 2 355 662 | A | 5/2001 |
| SU | 1766409 | A1 * | 10/1992 |
| WO | WO 00/10502 | A1 | 3/2000 |

* cited by examiner

WALKING AIDS

FIELD OF INVENTION

This invention relates to walking aids and, in particular, to the piece of a walking aid which engages with the ground.

BACKGROUND OF INVENTION

Walking aids include walking sticks, canes, crutches and the like which are used by individuals to assist in supporting them by taking some of the weight which would otherwise be borne by the feet alone. The walking aid is usually held in the hand in the case of a walking stick or cane, on the arm in the case of certain forms of crutch and underneath the arm in the case of other types. In all of these cases, an important desideratum is that the engagement between the base of the walking aid and the ground surface is adequate to prevent slipping. This may be achieved, for example, by a very small ground-engaging surface such as a spike or narrow ferrule, but this is not ideal, particularly if the walking aid is to be used indoors where such a small surface, because of the high pressure it generates, may cause damage to floors, carpets or the like.

An alternative approach is to have a high friction surface, larger area pad; rubbery end caps which fit over walking sticks and the like are well known. There are several commercially available designs, none of which is ideally suited to all conditions and many of which are inflexible insofar as the degree of grip they give depends very strongly on the angle between the support surface and the longitudinal axis of the cane or stick itself. EP-A-0605935 discloses a crutch tip incorporating two different materials with a view to improving the grip, but this will only operate properly when the crutch shaft is vertical.

A number of suggestions have been made in the patent literature to avoid this difficulty by enabling the end to swivel. Examples of such disclosures are EP-A-0112141, FR-A-2715559 and U.S. Pat. No. 5,865,204.

The greater the resistance of the foot slipping, so the greater the resistance of the cane to twisting, i.e. rotation about its elongate axis. This can make for discomfort in use, and accordingly it is known to provide, between the ground-engaging member and the stick or cane itself, a degree of rotational freedom.

A separate issue, of particular importance in the case of crutches but nevertheless also in the case of walking sticks, is the relative axial incompressibility of the stick itself. There have been a number of suggestions in the patent literature to provide walking aids with resilient feet, i.e. ones which are resiliently mounted on the shaft of the walking aid itself. These normally take the form of some type of telescoping arrangement with an internal spring. Examples of these are disclosed in GB-A-124691, WO 00-10502, U.S. Pat. No. 2,888,022, U.S. Pat. No. 2,856,943, U.S. Pat. No. 2,397,499, GB-A-613046, DE-U-8751507 and U.S. Pat. No. 2004/0035453.

DE-C-4136210 discloses an alternative approach to providing resilience in a crutch. It has a telescoping section with a cellular polyurethane elastomer cylindrical member as a shock absorber. U.S. Pat. No. 4,881,564 discloses a crutch tip with a deformable skirt and including a damping pad.

Many of the constructions disclosed in the various patent publications identified above are complex and susceptible in particular to failure in use on account of wear and tear, or the penetration of dust and grit into moving parts.

SUMMARY OF INVENTION

According to a first aspect of the present invention there is provided a walking aid such as a crutch, walking stick or the like having at its ground-engaging end a generally transverse end wall, formed on an end piece, wherein the end piece is fitted to a lower end of a shaft, and wherein the end piece, intermediate the portion fitted on to the shaft and the transverse ground-engaging end wall, is both axially compressible and laterally bendable whereby to enable the grounding-engaging end wall to lie flat against a surface with the shaft at an angle not normal thereto and simultaneously to absorb resiliently an axial load applied to the shaft.

While it is possible to conceive of end pieces of different construction, for example air-filled sealed ball or sac, the preferred construction of the end piece is one incorporating a bellows section. A bellows section may be compressed axially with the "folds" approaching one another evenly, or it may allow the folds to be compressed more on one side and less on the other (or even expanded on the other), so enabling the end piece effectively to bend.

Such a bellows section may be formed integrally with the remainder of the end piece, most conveniently by moulding. The moulding may be an integral moulding purely of a suitable rubbery or plastics material, or, for example, it may be of a composite material. Alternatively, the bellows section may be located intermediate a socket designed to fit on to the shaft and a ground-engaging foot member designed to contact the surface of the ground, and which may if desired be provided with a tread pattern to reduce the risk of slippage. The foot member may be held captive on the lower end of a bellows member by a retaining ring.

A bellows form also provides a high degree of lateral stability due to the stiffness of the pleats which can resist lateral or sideward loads but the hinge points between each pleat allow a large amount of vertical movement; this is of particular value where the walking aid is a crutch. Furthermore, the use of a sealed bellows, in which the air is compressed under load, acts as a damper and the higher the load the greater the damping. It also helps the bellows to recover to its original length once the load is released and the air expands back to its original pressure thereby forcing the bellows towards its original length. A bellows which is made from a stiff material as opposed to a rubbery material, will tend to shorten after time due to creep and permanent deflection at the hinge points. Therefore by using a sealed bellows containing air/gas or a compressible gel or other liquid/gas combination this can be overcome. A bellows made exclusively from a rubbery material may be too flexible for some applications and will not be able adequately to resist the lateral loads.

While simple bellows constructions may be appropriate for many cases, it is possible to conceive of using more complex arrangements, for example one in which, in a sealed bellows, there is an internal valve or constriction between two internal chambers, with fluid flow occurring from one to another via the valve or constriction when the bellows is loaded or unloaded. One way of achieving this in simple fashion is to mount two bellows together to form a bellows assembly which has two chambers separated by an air/liquid control device to control the movement of the internal fluid/gas from one chamber to the other and thereby control the rate of compression. By fixing two bellows together at their necks by welding or using a suitable joining device, a control device can be incorporated at the interface.

The degree of axial resilience and lateral bendability may be varied widely by appropriate constructional means. These may include the geometry and materials of which the bellows section or the entire end piece is made (for example using a bellows of non-circular cross-section), as well as, for example, the introduction of some form of central compression spring, for example in the form of a standard helical compression spring. However, as noted above, a bellows may be configured as a so-called "gas spring", i.e. a chamber filled or partly filled with a compressible fluid. The spring characteristics differ from that of a standard helical spring, but this can be of advantage in walking aids, giving a reasonable degree of axial movement under light axial loading with increasingly less movement as loading increases. If a gas spring type of bellows device is used, the particular characteristics may be varied by providing means to increase or decrease the internal pressure at rest.

The ground-engaging end of the end piece may be formed integrally with the end piece itself or, for example, may be in the form of an end plate or cap, e.g. of highly wear-resistant material, which is clipped or moulded on to the remainder of the end piece, or adhered or welded thereto. It may have a tread in order to increase grip. In order to avoid risk of penetration by sharp objects which could puncture the bellows, the end cap may include a transverse metal plate.

It is preferred to mount the end piece on the shaft of the cane, stick, crutch or the like in a way enabling its rotation about the longitudinal axis of the shaft, or to provide that the end piece itself is constructed so that the ground-engaging portion can be rotated with respect to the shaft-engaging portion around an axis parallel to that of the shaft. A particularly preferred way of achieving this in the case of an end piece incorporating a bellows is to form the end piece of a first portion having an end adapted to engage over the end of the shaft and an opposite socket and a second portion constituting or including a bellows having an axially protruding stub member which may be inserted for free rotation into the socket in the first portion.

A particularly elegant way of achieving this is to provide that the socket at its outer end is threaded and that the protuberant portion of the second member is threaded at its outer end, the length of the protuberant portion and depth of the socket being such that the two threads may be engaged one with another and, by continued rotation, then moved out of engagement with one another, with the outer end of the socket portion then engaging around the shaft of the protuberant portion and the distal end of the protuberant portion being located in the base of the socket.

Numerous other approaches may be adopted, but, as indicated above, preferred are simple mechanisms which may be easily constructed and fitted together and which are resistant to failure on being subjected to dust, grit, mud, water penetration, etc.

The end piece may be constructed so that it will fit on the shaft of any appropriate walking aid, for example by having a socket in it which is usually round for a walking stick or cane and may also be generally rectangular in the case of a crutch made of extruded rectangular section alloy tube. The end piece may have internally tapering ribs in a socket into which the shaft fits in order to provide a firm press-fit connection between the shaft and the end piece.

In accordance with a second aspect of the present invention, there is provided a walking aid such as a crutch, walking stick or the like incorporating an elongate shaft and including, between the shaft and a ground-engaging end piece or between two sections of the shaft a resilient bellows structure adapted to impart an overall resilient compressibility to the walking aid in the direction of the elongate shaft.

Where the bellows structure is incorporated into the shaft itself, the sections of the shaft either side may be configured to ensure that the resilience is maintained but without the shaft being able to bend materially about the bellows. This may be achieved, for example, by locating the bellows in a hollow section of a part of the elongate shaft with the other part carrying a sleeve which is a telescopic fit over the first part of the shaft.

The bellows structure incorporated into the shaft is preferably a sealed bellows structure acting as an air spring between the two parts of the shaft.

BRIEF DESCRIPTION OF DRAWINGS

The invention is illustrated by way of example with reference to the accompanying drawings in which.

DETAILED DESCRIPTION OF INVENTION

Figure 1:
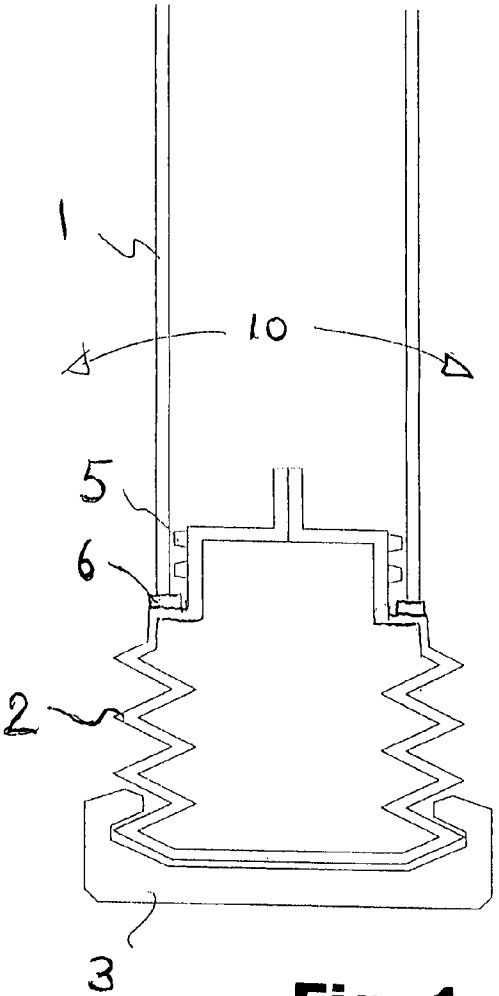
FIG. 1 is an axial sectional view of the lower end of a walking aid including an end piece in accordance with the present invention.

Referring to FIG. 1, the shaft of a walking aid such as a stick or crutch is denoted 1 and has fitted to its base an end piece consisting of a sealed integral moulded bellows unit 2 around the lower end of which is clipped a relatively hard moulded rubber cap 3.

The upper end of the bellows unit 2 has a pair of lateral protuberant beads 5 which are a press fit inside shaft 1. Located between the bellows portion of bellows unit 2 and the lower end of shaft 1 is a steel washer 6 which distributes the axial load on the top of the bellows unit 2.

As can be readily appreciated, the angle of the shaft 1 may be varied as indicated by the double-headed arrow 10, with the ground-engaging cap 3 staying fixed in position. At the same time, if the shaft 1 is axially loaded, then the axial extent of bellows 2 decreases.

Figure 2:
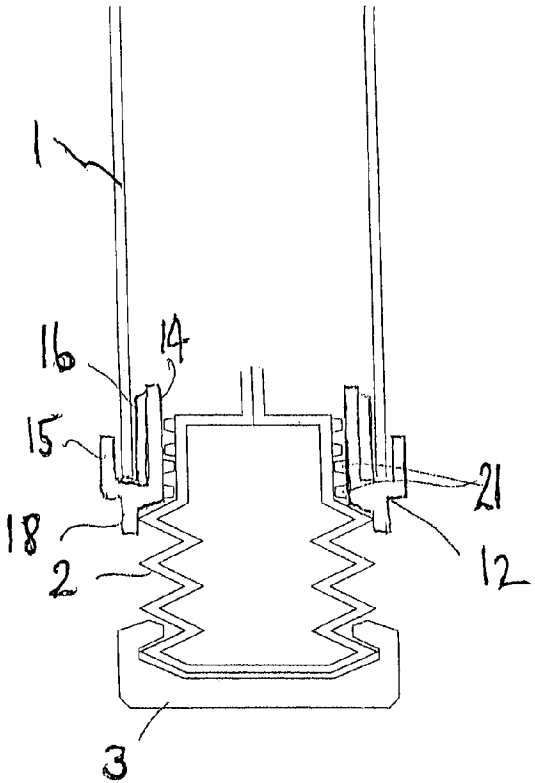
FIG. 2 is a similar axial section showing an alternative embodiment.

FIG. 2 shows an arrangement similar to FIG. 1 and the same reference numerals are used for corresponding components. However, as shown in FIG. 2, the upper end of the bellows 2 is set in an intermediate short sleeve member 12 which is fitted between shaft 1 and bellows 2.

Upwardly, member 12 has an annular groove defined between an inner cylindrical wall 14 and an outer cylindrical wall 15, with the lower end of shaft 1 penetrating into the groove. Resilient ribs 16 are moulded on to the wall 14 and serve to engage the interior wall of shaft 1 to hold member 12 firmly on shaft 1.

Member 12 also has a depending annular skirt 18 which assists in controlling the location of the bellows 2. On the interior cylindrical wall of member 12 are annular ribs 21 which are of such a size, shape and resilience that ribs 5 on the top of the bellows 2 can be pushed past them so that the bellows 2 is lodged in member 12 and held captive in it as shown in FIG. 2. The dimensions are such that the bellows 2 is a loose fit and accordingly can rotate about the longitudinal axis of shaft 1 relative to that shaft.

Figure 3:
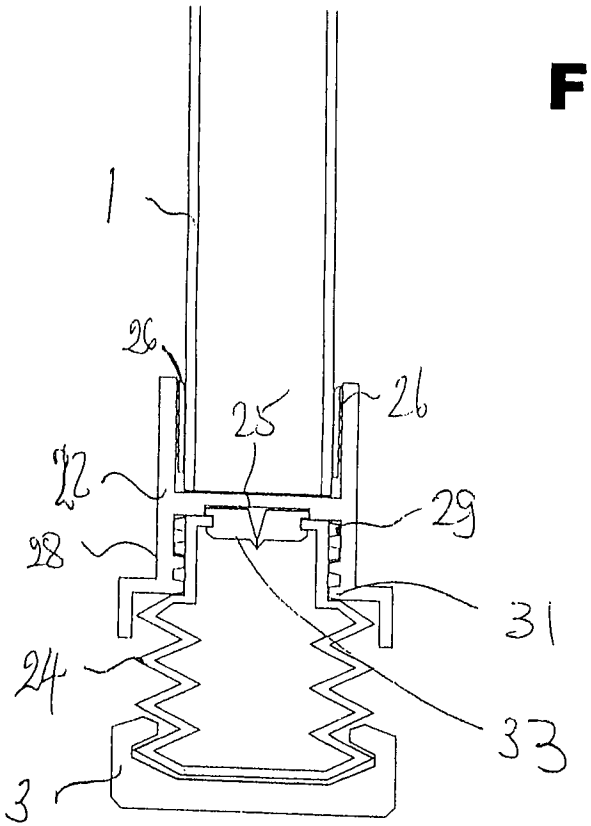
FIG. 3 is a further axial section showing a further embodiment.

FIG. 3 shows yet a further version where there is a bellows between a shaft 1 and an intermediate piece 22 on the one hand and a ground-engaging end cap 3 on the other. In the case illustrated in FIG. 3, however, the intermediate piece 22 consists of a double-ended sleeve having a transverse dividing wall 25 across it. Wall 25 acts as a stop to limit the degree of insertion of shaft 1 into member 22. Ribs 26 ensure a tight frt.

The lower portion of the member 22 is in the form of a socket 28 into which a bellows 24 is screwed. The top end of bellows 24 has a couple of turns of helical thread 29 on it and the lower portion of sleeve 28 likewise a couple of turns of helical thread 31 on it. As shown, threads 29 and 31 can be made to cross over one another leaving the bellows 24 and end cap 3 rotatably set in the socket portion 28 of the intermediate member 22.

As shown in FIG. 3, the upper end of the bellows 24 is closed by a sealing bung 33. If it is desired to stiffen the resistance of the bellows 24 to axial compression, air may be injected through bung 33 which is then sealed within bellows 24 under whatever pressure is appropriate. The axial spring characteristics of bellows 24 may also be changed by introducing a certain quantity of liquid into the interior of bellows 24.

Figure 4:
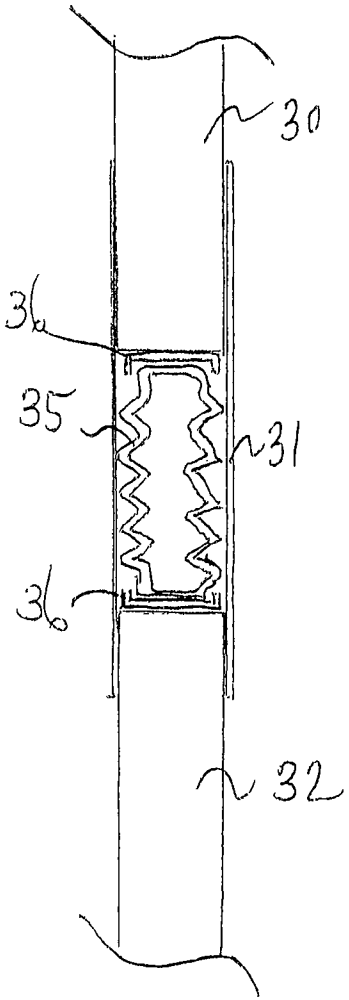
FIG. 4 is an axial section of part of a stick or crutch according to a further embodiment.

Referring now to FIG. 4, this is an axial section of a shaft of a walking stick into which a resilient sealed bellows has been incorporated. As can be seen in FIG. 4, the upper portion of the shaft 30 slides in a cylindrical sleeve 31 which is fast with the lower portion of the shaft 32. Mounted in cylindrical sleeve 31 and abutting the top end of shaft portion 32 is a sealed bellows unit 35 which is axially compressible. It may carry suitable end pieces 36 to minimise the wear and prolong its service life. The upper portion of the shaft 30 may be rendered captive in sleeve 31 by any convenient means, for example a pin passing through the base of shaft portion 30 and sliding in a pair of axial slots in sleeve 31, though that particular method prevents portions 30 and 32 of the shaft twisting about the shaft axis relative to one another. Such twisting movement can be advantageous, as explained above, but if it is not needed, then the shaft may be of other than circular cross-section, for example oval or square.

As illustrated in the drawings, use is made of a resilient bellows to provide resilience and, in the case of the embodiments shown in FIGS. 1 to 3, bendability of the lowermost part of the walking aid. In any such case, the particular mechanical characteristics of the bellows will depend on its geometry and material of construction. This may be varied widely, but it is not always straightforward to make long relatively narrow bellows. In such a case, two shorter lower aspect ratio bellows may be aligned with one another to provide a composite bellows system in a simple and cost-effective fashion.

FIGS. 5 to 10 show diagrammatically a variety of further end piece constructions, each of which is fitted on to the end of a shaft 1, for example of a walking stick.

Figure 5:
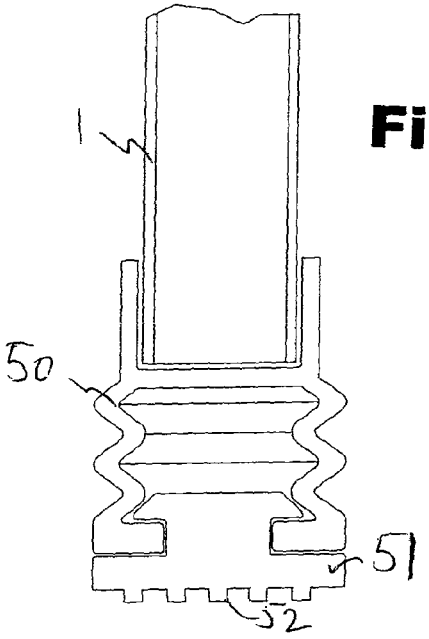
FIGS. 5 to 10 are diagrammatic axial sections of further end pieces for use in constructing walking aids according to the present invention.

In FIG. 5, a moulded bellows 50 has a socket on one end into which the shaft 1 fits and in its other end has a hole which is plugged by a foot member 51 which essentially seals the bellows. The base of foot member 51 has a ground-engaging tread 52.

Figure 6:
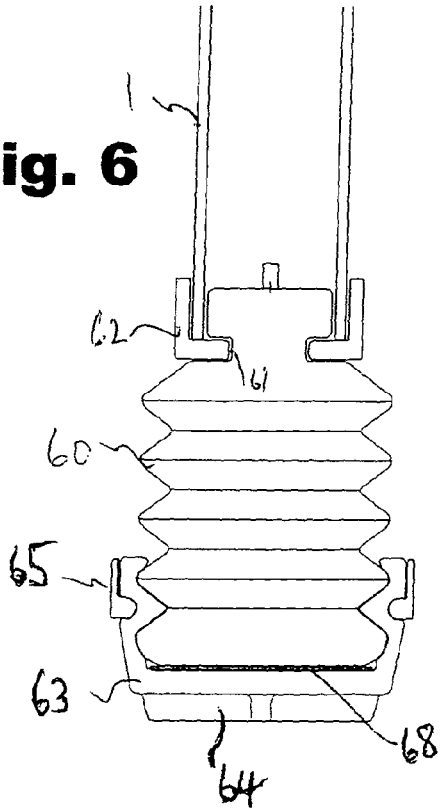

Referring to FIG. 6, a blow-moulded bellows unit 60 has a groove at one end enabling it to be received into a circular aperture in an end cap 62 which is a press fit on the shaft 1. A ground-engaging rubber moulding 63 with a tread pattern 64 is held on to the lower end of the bellows 60 by means of a retaining ring 65. A metal plate 68 is located between the lower end of the bellows 60 and the inside of foot 63 so that if a sharp object should penetrate through the material of foot 63, it will nevertheless not penetrate into the bellows itself, thus puncturing it.

Figure 7:
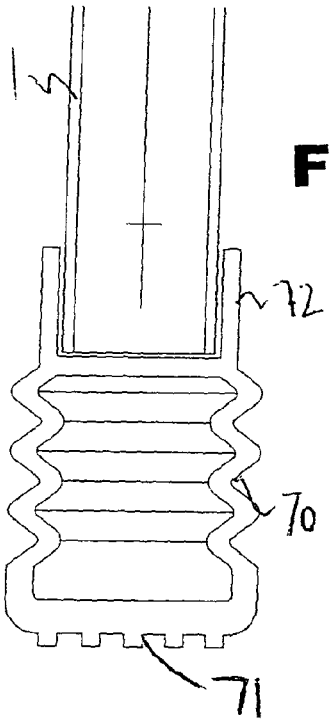

FIG. 7 shows a single piece moulded bellows 70 having a tread formation 71 at its lower end and an integrally moulded socket 72 at its upper end for receiving shaft 1.

Figure 8:
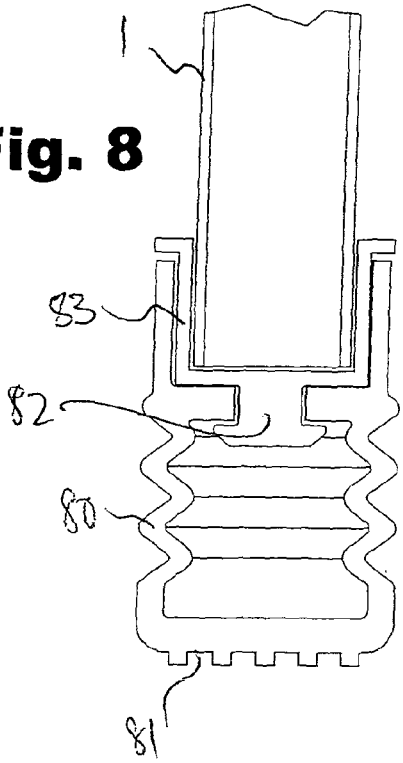

FIG. 8 shows an integrally moulded rubber bellows 80 having a tread 81 and which is sealed by a plug 82. Plug 82 is formed integrally with an end cap 83 into which the shaft 1 fits.

Figure 9:
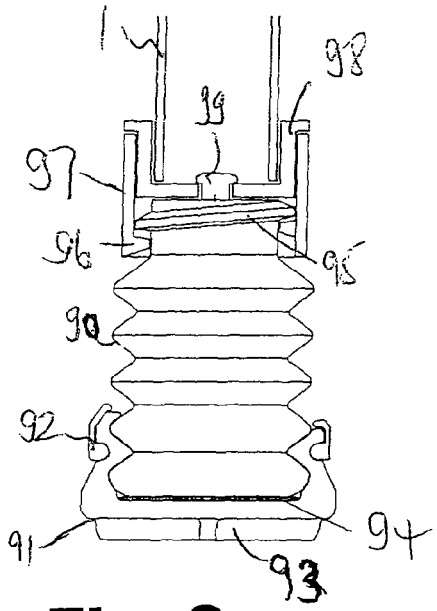

FIG. 9 shows a construction including a moulded bellows 90 having a rubber foot 91 held on its lower end by a clip 92. Foot 91 has a tread 93 and a penetration resistant plate 94 is located between the lower end of bellows 90 and the inner surface of foot 91. At the top, the upper end of bellows 90 has a single turn screw thread 95 on it which is designed to cooperate with a threaded portion 96 of a collar 97. Screw thread 95 can pass beyond thread 96 sufficiently to enable the bellows to rotate about the axis of shaft 1 without unscrewing itself from the end. Collar 97 is located on a cup member 98 which has a central aperture. A stud 99 at the top of the bellows 90 may fit loosely. Shaft 1 is a press fit on the inside of cup member 98.

Figure 10:
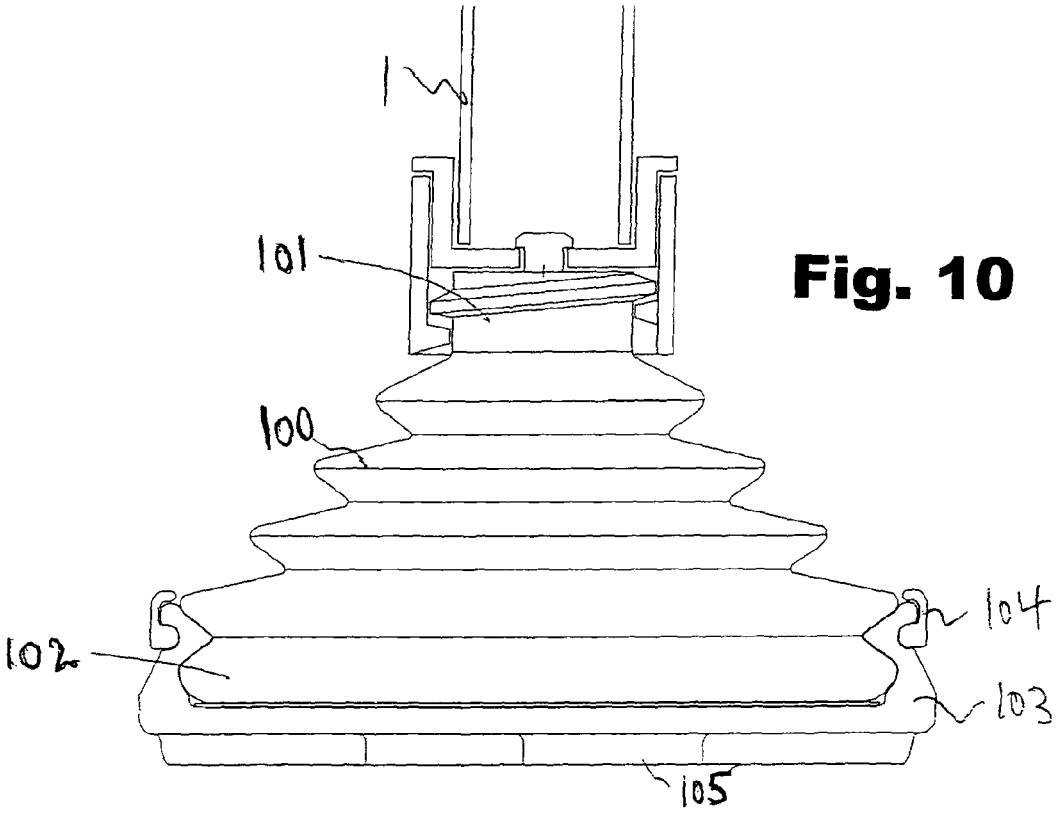

FIG. 10 shows diagrammatically a construction analogous to FIG. 9, but where the bellows member itself, denoted 100, increases in diameter between the threaded portion 101 at its top and a wide foot portion 102 which fits inside a wide moulded foot 103. Foot 103 is secured by a circular retaining clip 104 and has a tread pattern 105 on its base. The advantage of the structure shown in FIG. 10 is that the substantially greater surface area of the foot allows the stick, crutch or the like to be stood vertically on the ground without tipping over provided that the ground itself is sufficiently close to horizontal. This is of considerable value when the walking aid is a walking stick because it means that the user can temporarily simply release his or her grip on the stick in order, for example, to carry out some other manual activity, without having to "park" the stick previously in a position from which it can subsequently be retrieved. The user can simply move their hand away from the stick and then grasp it again afterwards.

The invention claimed is:

1. A waking aid for engaging a ground surface comprising a ground-engaging end with a substantially transverse end wall, formed on an end piece, wherein a portion of the need piece is constructed to fit to a lower end of a shaft, and wherein the end piece, intermediate the portion to be fit to a shaft and the transverse end wall, includes a resilient bellows section which is both axially compressible, to impart a degree of axial compressibility between the ground-engaging end and the shaft, and laterally bendable whereby to enable the transverse end wall to adjust position so as to lie flat against various types of ground surfaces and at an angle not normal to a shaft when connected thereto, and wherein the resilient bellows section comprises a pleated bellows with stiff pleats and includes hinge points between the pleats to allow a degree of vertical movement in the pleated bellows, wherein the end piece further comprises a socket constructed to fit onto the shaft and the ground-engaging end constructed to contact the ground surface, wherein the resilient bellows section is located intermediate the socket and the ground-engaging end, and wherein the end piece is constructed so that the ground-engaging end thereof is freely rotatable with respect to the socket tightly fitted onto the lower end of the shaft around an axis parallel to that of the shaft when the end piece is fitted to the shaft.

2. The walking aid according to claim 1, wherein the resilient bellows section is an integral part of the end piece.

3. The walking aid according to claim 2, wherein the end piece is an integral component molded from a rubber or plastic material.

4. A walking aid for engaging a ground surface comprising a ground-engaging end with a substantially transverse end wall, formed on an end piece, wherein a portion of the need piece is constructed to fit to a lower end of a shaft, and wherein the end piece, intermediate the portion to be fit to a shaft and the transverse end wall, includes a resilient bellows section which is both axially compressible, to impart a degree of axial compressibility between the ground-engaging end and the shaft, and laterally bendable whereby to enable the transverse end wall to adjust position so as to lie flat against various types of ground surfaces and at an angle not normal to a shaft when connected thereto, and wherein the resilient bellows section comprises a pleated bellows with stiff pleats and includes hinge points between the pleats to allow a degree of vertical movement in the pleated bellows, wherein the end piece further comprises a socket constructed to fit onto the shaft and the ground-engaging end constructed to contact the ground surface, wherein the resilient bellows section is located intermediate the socket and the ground-engaging end, and wherein the ground-engaging end is held on a lower end of the bellows section by a retaining ring.

5. A walking aid for engaging a ground surface comprising a ground-engaging end with a substantially transverse end wall, formed on an end piece, wherein a portion of the need piece is constructed to fit to a lower end of a shaft, and wherein the end piece, intermediate the portion to be fit to a shaft and the transverse end wall, includes a resilient bellows section which is both axially compressible, to impart a degree of axial compressibility between the ground-engaging end and the shaft, and laterally bendable whereby to enable the transverse end wall to adjust position so as to lie flat against various types of ground surfaces and at an angle not normal to a shaft when connected thereto, and wherein the resilient bellows section comprises a pleated bellows with stiff pleats and includes hinge points between the pleats to allow a degree of vertical movement in the pleated bellows, wherein the end piece further comprises a socket constructed to fit onto the shaft and the ground-engaging end constructed to contact the ground surface, wherein the resilient bellows section is located intermediate the socket and the ground-engaging end, and wherein a ground-engaging end of the end piece is in a form of an end plate or end cap of highly wear-resistant material, which is clipped or molded onto the end piece.

6. The walking aid according to claim 5, wherein the end cap includes a transverse metal plate resistant to penetration of the bellows section by sharp objects.

7. A walking aid for engaging a ground surface comprising a ground-engaging end with a substantially transverse end wall, formed on an end piece, wherein a portion of the need piece is constructed to fit to a lower end of a shaft, and wherein the end piece, intermediate the portion to be fit to a shaft and the transverse end wall, includes a resilient bellows section which is both axially compressible, to impart a degree of axial compressibility between the ground-engaging end and the shaft, and laterally bendable whereby to enable the transverse end wall to adjust position so as to lie flat against various types of ground surfaces and at an angle not normal to a shaft when connected thereto, and wherein the resilient bellows section comprises a pleated bellows with stiff pleats and includes hinge points between the pleats to allow a degree of vertical movement in the pleated bellows, wherein the end piece is constructed so that the ground-engaging end is rotatable with respect to the lower end of the shaft around an axis parallel to that of the shaft when the end piece is fitted to the shaft, and wherein the end piece is formed of a first portion having an end adapted to engage over an end of a shaft and a opposite socket and a second portion constituting or including the bellows section having an axially protruding stub member which is insertable for free rotation into a socket in the first portion.

* * * * *